US011168427B2

(12) United States Patent
Cho et al.

(10) Patent No.: US 11,168,427 B2
(45) Date of Patent: Nov. 9, 2021

(54) GARMENT PROCESSING DEVICE

(71) Applicant: LG ELECTRONICS INC., Seoul (KR)

(72) Inventors: Hongjun Cho, Seoul (KR); Sanghun Bae, Seoul (KR); Youngjoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/335,997

(22) PCT Filed: Sep. 22, 2017

(86) PCT No.: PCT/KR2017/010479
§ 371 (c)(1),
(2) Date: Mar. 22, 2019

(87) PCT Pub. No.: WO2018/056756
PCT Pub. Date: Mar. 29, 2018

(65) Prior Publication Data

US 2020/0024785 A1 Jan. 23, 2020

(30) Foreign Application Priority Data

Sep. 23, 2016 (KR) ..... 10-2016-0122037

(51) Int. Cl.
*D06F 37/10* (2006.01)
*D06F 37/28* (2006.01)
(Continued)

(52) U.S. Cl.
CPC ..... *D06F 37/10* (2013.01); *D06F 37/28* (2013.01); *E05D 15/50* (2013.01); *E05D 15/52* (2013.01);
(Continued)

(58) Field of Classification Search
CPC ..... D06F 37/10; D06F 37/28; D06F 37/42; D06F 58/20; D06F 39/14; E05D 15/522;
(Continued)

(56) References Cited

U.S. PATENT DOCUMENTS 1,563,876 A * 12/1925 Smith ..... E05F 5/02 16/86 A
3,018,508 A 1/1962 Keeling, Sr.
(Continued)

FOREIGN PATENT DOCUMENTS

CN 103225194 7/2013
CN 103314151 9/2013
(Continued)

OTHER PUBLICATIONS

Chinese Office Action (with English translation) dated Aug. 4, 2020 issued in CN Application No. 201780058900.3.
(Continued)

*Primary Examiner* — Hanh V Tran
(74) *Attorney, Agent, or Firm* — Ked & Associates, LLP

(57) ABSTRACT

A garment processing device door comprises an exposed first compartment, and a second compartment separated by a barrier; a first switch reciprocating inside the second compartment and connecting the door to a first rotation axis; a second switch reciprocating inside the second compartment and connecting the door to a second rotation axis when the door from the first rotation axis; a first body having one end rotatably fixed to the first compartment and another end penetrating the barrier and in the second compartment; a second body fixed to the first body and inside the second compartment, the second body moving the first switch to separate the door from the first rotation axis based on a force to the first body, and the second body moving toward the barrier when the first switch connects the door to the first
(Continued)

rotation axis; and a damper between the second body and the barrier.

13 Claims, 10 Drawing Sheets

(51) Int. Cl.

| | |
|---|---|
| ***E05F 5/02*** | (2006.01) |
| ***E05D 15/52*** | (2006.01) |
| ***E05D 15/50*** | (2006.01) |
| ***E05D 15/522*** | (2006.01) |
| ***E05D 7/02*** | (2006.01) |
| ***E05D 7/10*** | (2006.01) |

(52) U.S. Cl.
CPC ..... *E05D 15/522* (2013.01); *E05F 5/02* (2013.01); *E05D 7/02* (2013.01); *E05D 7/1066* (2013.01); *E05Y 2900/312* (2013.01)

(58) Field of Classification Search
CPC E05D 15/52; E05D 15/50; E05D 7/02; E05D 7/1066; E05D 1/04; E05D 15/505; E05F 5/02; E05Y 2900/312; E05Y 2800/102; E05Y 2201/22; E05Y 2800/11
See application file for complete search history.

(56) References Cited

U.S. PATENT DOCUMENTS

| | | | | |
|---|---|---|---|---|
| 3,698,781 | A | 10/1972 | Dunn | |
| 7,984,955 | B2 * | 7/2011 | Jung | F25D 23/028 312/405 |
| 8,936,330 | B2 | 1/2015 | Kim et al. | |
| 10,119,219 | B2 * | 11/2018 | Lee | D06F 37/28 |
| 10,321,798 | B2 * | 6/2019 | Park | A47L 15/4219 |
| 10,753,130 | B2 * | 8/2020 | Lee | E05D 15/522 |
| 2005/0217072 | A1 * | 10/2005 | Lin | E05F 5/02 16/85 |
| 2008/0223594 | A1 * | 9/2008 | Eisenhardt | B25F 5/006 173/162.2 |
| 2009/0119876 | A1 * | 5/2009 | Pecar | E05F 5/006 16/293 |
| 2009/0283282 | A1 * | 11/2009 | Zimmermann | B25D 17/043 173/162.2 |
| 2012/0056518 | A1 * | 3/2012 | Kwak | D06F 39/14 312/228 |
| 2012/0161594 | A1 | 6/2012 | Kim et al. | |
| 2012/0187811 | A1 | 7/2012 | Kim et al. | |
| 2012/0217851 | A1 | 8/2012 | Bae et al. | |
| 2013/0076220 | A1 | 3/2013 | Yeom et al. | |
| 2013/0193823 | A1 | 8/2013 | Cho et al. | |
| 2014/0035453 | A1 | 2/2014 | Kwon et al. | |
| 2015/0233039 | A1 * | 8/2015 | Cho | D06F 37/268 312/228 |
| 2015/0233042 | A1 | 8/2015 | Kang et al. | |
| 2015/0233043 | A1 | 8/2015 | Sim et al. | |
| 2016/0076186 | A1 * | 3/2016 | Lee | E05D 7/1044 312/228 |
| 2016/0076187 | A1 | 3/2016 | Lee et al. | |
| 2016/0177611 | A1 * | 6/2016 | Rissone | E05B 17/0041 267/139 |
| 2016/0194802 | A1 | 7/2016 | Heo et al. | |
| 2017/0009392 | A1 | 1/2017 | Lee et al. | |

FOREIGN PATENT DOCUMENTS

| | | | | |
|---|---|---|---|---|
| CN | 103608510 | | 2/2014 | |
| CN | 104846585 | | 8/2015 | |
| CN | 104846600 | | 8/2015 | |
| CN | 105420986 | | 3/2016 | |
| KR | 20-1995-0000950 | | 2/1995 | |
| KR | 20-1995-005949 | | 7/1995 | |
| KR | 20-0138847 | | 4/1999 | |
| KR | 20-1999-0029441 | | 7/1999 | |
| KR | 10-0640751 | | 10/2006 | |
| KR | 10-2013-0032993 | | 4/2013 | |
| KR | 10-2013-0071844 | | 7/2013 | |
| KR | 10-2014-0018565 | | 2/2014 | |
| KR | 10-2015-0097185 | | 8/2015 | |
| KR | 10-2015-0109814 | | 10/2015 | |
| KR | 10-2016-0084327 | | 7/2016 | |
| KR | 10-1653314 | | 9/2016 | |
| WO | WO-2015142122 | A1 * | 9/2015 | D06F 58/20 |

OTHER PUBLICATIONS

Chinese Office Action (with English translation) dated Aug. 5, 2020 issued in CN Application No. 201780058899.4.
U.S. Appl. No. 16/335,997, filed Mar. 22, 2019.
U.S. Appl. No. 16/336,025, filed Mar. 22, 2019.
U.S. Appl. No. 16/336,048, filed Mar. 22, 2019.
U.S. Appl. No. 16/336,057, filed Mar. 22, 2019.
United States Notice of Allowance dated Apr. 15, 2020 issued in U.S. Appl. No. 16/336,048.
United States Notice of Allowance dated Apr. 15, 2020 issued in U.S. Appl. No. 16/336,057.
United States Notice of Allowance dated Oct. 20, 2020 issued in U.S. Appl. No. 16/336,025.
International Search Report and Written Opinion (with English Translation) dated Jan. 4, 2018 issued in Application No. PCT/KR2017/010450.
International Search Report and Written Opinion (with English Translation) dated Jan. 11, 2018 issued in Application No. PCT/KR2017/010479.
International Search Report and Written Opinion (with English Translation) dated Jan. 11, 2018 issued in Application No. PCT/KR2017/010452.
International Search Report and Written Opinion (with English Translation) dated Jan. 19, 2018 issued in Application No. PCT/KR2017/010474.

* cited by examiner (a)

(b)

GARMENT PROCESSING DEVICE

CROSS-REFERENCE TO RELATED PATENT APPLICATIONS

This application is a U.S. National Stage Application under 35 U.S.C. § 371 of PCT Application No. PCT/KR2017/010479, filed Sep. 22, 2017, which claims priority to Korean Patent Application No. 10-2016-0122037, filed Sep. 23, 2016, whose entire disclosures are hereby incorporated by reference.

TECHNICAL FIELD

The present disclosure relates to a laundry-treating apparatus.

BACKGROUND

In general, the laundry-treating apparatus refers to a collective term of home appliances capable of washing or drying laundry, or washing and drying the laundry.

In the laundry-treating apparatus, laundry washing removes contaminants from the laundry via interaction between water and detergent. Drying of laundry removes moisture contained in laundry via a hot air supply device provided in the laundry-treating apparatus.

Conventionally, a laundry-treating apparatus includes a cabinet forming an appearance, a laundry receiving portion provided in the cabinet for receiving laundry, a laundry inlet defined in the cabinet for communicating with the laundry receiving portion, and a door for opening and closing the laundry inlet.

In the conventional laundry-treating apparatus, the door is generally pivotable about a vertical axis formed along a height direction of the cabinet.

DISCLOSURE

Technical Purpose

One purpose of the present disclosure is to provide a laundry-treating apparatus in which a pivoting direction of a door is switched in opening a laundry inlet.

Further, another purpose of the present disclosure is to provide a laundry-treating apparatus that allows an user to select a pivoting axis of a door.

Further, still another purpose of the present disclosure is to provide a laundry-treating apparatus that prevents a pivoting axis from changing while the door is opening a laundry inlet.

Furthermore, still another purpose of the present disclosure is to provide a laundry-treating apparatus capable of minimizing a noise level when changing the pivoting axis for the door.

Technical Solution

In one aspect of the present disclosure, there is provided a laundry-treating apparatus comprising: a cabinet having a laundry inlet defined therein; a laundry receiving portion defined in the cabinet, wherein the laundry receiving portion receives laundry through the laundry inlet; a door for opening and closing the laundry inlet, wherein the door has a first receiving space defined therein exposed to an outside and a second receiving space defined therein separated from the first receiving space via a partitioning wall, a first pivoting axis about which the door pivots in a first direction; a second pivoting axis about which the door pivots in a second direction different from the first direction; a first switch configured to reciprocate within the second receiving space, wherein the first switch is configured to connect the door to the first pivoting axis; a second switch configured to reciprocate within the second receiving space, wherein when the first switch moves the door to be separated from the first pivoting axis, the second switch is configured to connect the door to the second pivoting axis; a first body having one end pivotably secured to the door in the first receiving space and the other end located in the second receiving space, wherein the first body passes through the partitioning wall; a second body fixed to the first body and located inside the second receiving space, wherein when an external force is applied to the first body, the second body moves the first switch so that the door is separated from the first pivoting axis, wherein when the first switch moves to connect the door to the first pivoting axis, the second body moves toward the partitioning wall; and a damper configured to reduce a movement speed of the second body toward the partitioning wall or to prevent the second body from colliding against the partitioning wall.

In one embodiment, the damper includes an elastic body fixed to either the partitioning wall or the second body to prevent the second body from colliding with the partitioning wall, wherein the elastic body includes an elastic member.

In one embodiment, the damper includes a protrusion protruding from a face of the elastic body contacting the second body.

In one embodiment, the damper includes a groove concavely defined in a face of the elastic body in contact with the partitioning wall.

In one embodiment, the apparatus further comprises: a movable portion included in the second body; and a contact included in the first switch, wherein when the contact is pressed by the movable portion, the contact moves the first switch to separate the door from the first pivoting axis.

In one embodiment, the damper includes: a groove defined in one of the movable portion and the contact; a first protrusion to divides the groove into a first groove and a second groove; a second protrusion extending from the other of the movable portion and the contact, wherein the second protrusion reciprocates between the first groove and the second groove, wherein the second protrusion interferes with the first protrusion when reciprocating between the first groove and the second groove.

In one embodiment, when the first switch is in a position to couple the door to the first pivoting axis, the second protrusion is configured to be located in the first groove, wherein when the first switch is in a position to separate the door from the first pivoting axis, the second protrusion is configured to be located in the second groove.

In one embodiment, the apparatus further comprises: a first hinge including: a first shaft disposed on one of the cabinet and the door and defining the first pivoting axis for the door; and a first shaft receiving portion disposed on the other of the cabinet and the door, wherein the first shaft receiving portion receives the first shaft therein; a second hinge including: a second shaft coupled to the door, wherein the first and second shafts define the first pivoting axis; and a third shaft for pivotably fixing the second shaft to the cabinet, wherein the third shaft defines the second pivoting axis for the door; a third hinge including: a fourth shaft disposed on one of the cabinet and the door, wherein the third and fourth shafts define the second pivoting axis; and a fourth shaft receiving portion disposed on the other of the cabinet and the door, wherein the fourth shaft receiving portion receives the fourth shaft therein, wherein the first switch is configured to open and close the first shaft receiving portion, wherein the second switch is configured to open and close the fourth shaft receiving portion, wherein when the first switch moves in a direction to open the first shaft receiving portion, the second switch is configured to close the fourth shaft receiving portion.

In one embodiment, the apparatus further comprises an elastic support to press the first switch toward the first shaft receiving portion such that the door is kept at a coupled switch to the first pivoting axis when the door closes the laundry inlet.

In one embodiment, the apparatus further comprises a first lock for locking the first switch when the door opens the laundry inlet.

In one embodiment, the first lock is configured to be separated from the first body or the second body when the door closes the laundry inlet, wherein the first lock is configured to be coupled to the first body or the second body when the door opens the laundry inlet.

In one embodiment, the first lock is configured to be separated from the first switch when the door closes the laundry inlet, wherein the first lock is configured to be coupled to the first switch when the door opens the laundry inlet.

In one embodiment, the apparatus further comprises a second lock for locking the second switch when the door opens the laundry inlet.

In one embodiment, the second lock is configured to be separated from the second switch when the door closes the laundry inlet, wherein the second lock is configured to be coupled to the second switch when the door opens the laundry inlet.

Technical Effect

In accordance with the present disclosure, a laundry-treating apparatus in which a pivoting direction of a door is switched in opening a laundry inlet may be realized.

Further, in accordance with the present disclosure, a laundry-treating apparatus that allows an user to select a pivoting axis of a door may be realized.

Further, in accordance with the present disclosure, a laundry-treating apparatus that prevents a pivoting axis from changing while the door is opening a laundry inlet may be realized.

Furthermore, in accordance with the present disclosure, a laundry-treating apparatus capable of minimizing a noise level when changing the pivoting axis for the door may be realized.

DETAILED DESCRIPTIONS

Figure 1:
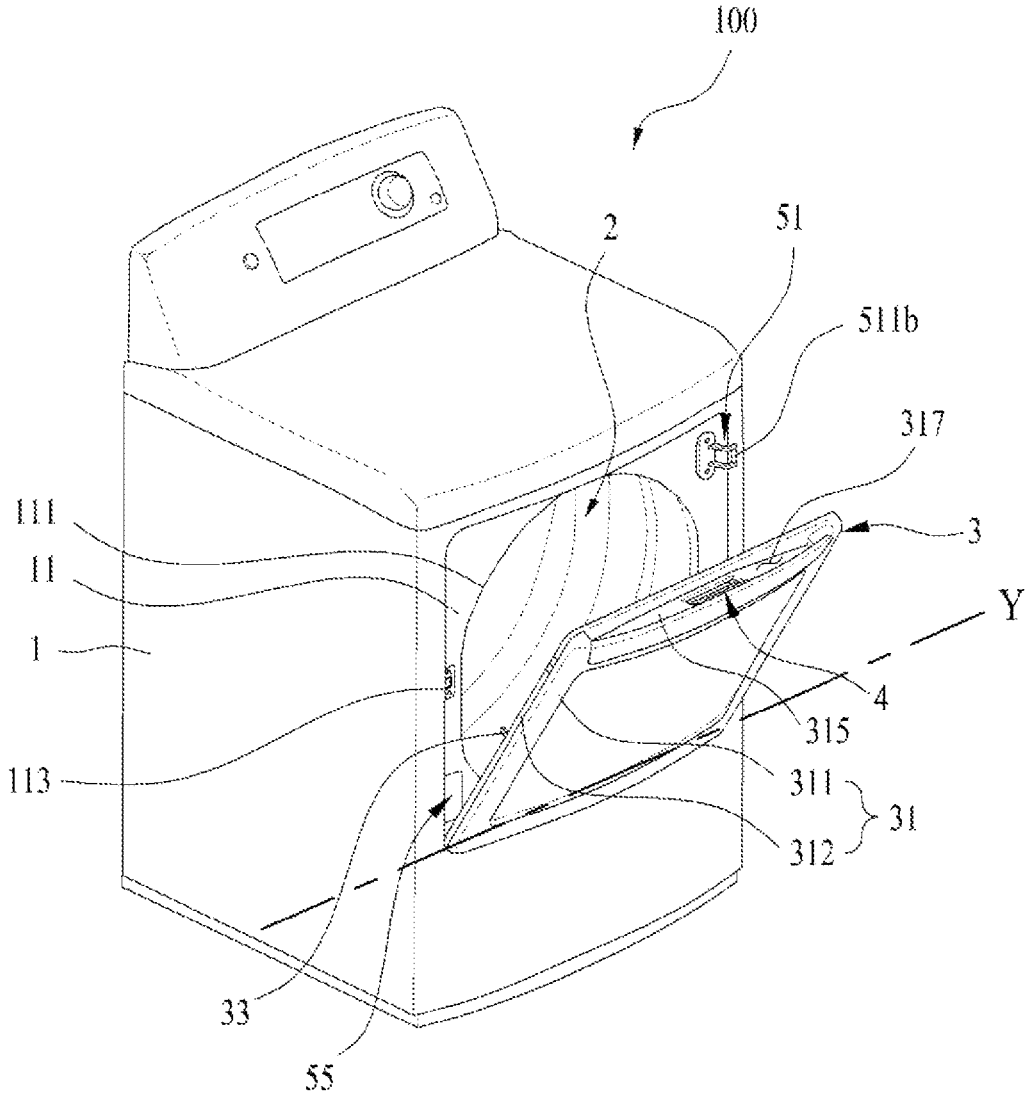
FIG. 1 shows an example of laundry-treating apparatus in accordance with the present disclosure, in which a door pivots around a second pivoting axis to open an laundry inlet.

Hereinafter, preferred embodiments of the present disclosure will be described in detail with reference to the accompanying drawings. A configuration and control method of the apparatus as described below are intended to illustrate embodiments of the present disclosure and not to limit the scope of the present disclosure. Like reference numerals refer to like elements throughout the present specification.

As shown in FIG. 1, a laundry-treating apparatus 100 according to the present disclosure includes a cabinet 1 forming an appearance, a laundry receiving portion 2 defined in the cabinet 1 for accommodating laundry, and a door 3 disposed on the cabinet 1 for exposing the laundry receiving portion 2 to the outside.

A front panel 11 of the cabinet 1 has a laundry inlet 111 defined therein. The door 3 is disposed on the front panel 11 so that the laundry inlet 111 may be opened and closed by the door 3. Thus, the user may pivot the door 3 to open the laundry inlet 111 to load laundry (washing or drying target) into the laundry receiving portion 2 or draw the laundry from the receiving space 2.

When the laundry-treating apparatus 100 according to the present disclosure functions as a washing apparatus, a tub for storing wash-water therein is disposed in the cabinet, and a drum is rotatably installed in the tub and has a space for accommodating laundry defined therein. In this case, the tub has a tub laundry inlet communicating with the laundry inlet 111. The drum has a drum laundry inlet communicating with the tub laundry inlet and the laundry inlet 111.

Further, the laundry-treating apparatus 100 further includes a washing-water supply (not shown) for supplying washing water to the tub, and a washing-water discharger (not shown) for discharging washing water stored in the tub to the outside of the cabinet 1.

In an alternative, when the laundry-treating apparatus 100 according to the present disclosure only acts to dry laundry, the laundry receiving portion 2 is defined only in the drum rotatably installed in the cabinet 1. That is, the tub is absent. In this case, an air supply (not shown) is present inside the cabinet to supply hot air to the drum. Further, an air discharger (not shown) is present inside the cabinet to discharge the air from the drum to the outside of the drum.

In one example, the laundry-treating apparatus 100 according to the present disclosure may be capable of washing and drying laundry. In this case, the tub for storing wash-water therein is disposed in the cabinet, and the drum is rotatably installed in the tub and has a space for accommodating laundry defined therein. The cabinet will include a washing-water supply, a washing-water discharger, an air supply (not shown) for supplying hot air to the tub, and an air discharger (now shown) for discharging air out of the tub.

The door 3 disposed on the front panel 11 for opening and closing the laundry inlet 111 is pivotable around two different pivoting axes (X, Y). The door 3 is coupled to a front panel 11 via hinges 51, 53 and 55. The user may switch the pivoting axis (X, Y) for the door 3 using an actuator (or handle) 4.

The door 3 may include a door body 31 for opening and closing the laundry inlet 111, and a door lock 33 for detachably fixing the door body 31 to the front panel 11.

The door body 31 may include an outer frame 311 forming an outer circumferential surface of the laundry-treating apparatus 100, and an inner frame 312 coupled to the outer frame 311 and facing the laundry inlet.

The door lock 33 may protrude from a surface of the inner frame 312. In this case, the front panel 11 may further include a door lock catch 113 into which the door lock 33 is to be accommodated.

In one example, the door lock 33 and the door lock catch 113 may be embodied in any configuration as long as the door body 31 may be detachably secured to the front panel 11 via the door lock 33 and the door lock catch 113.

Figure 2:
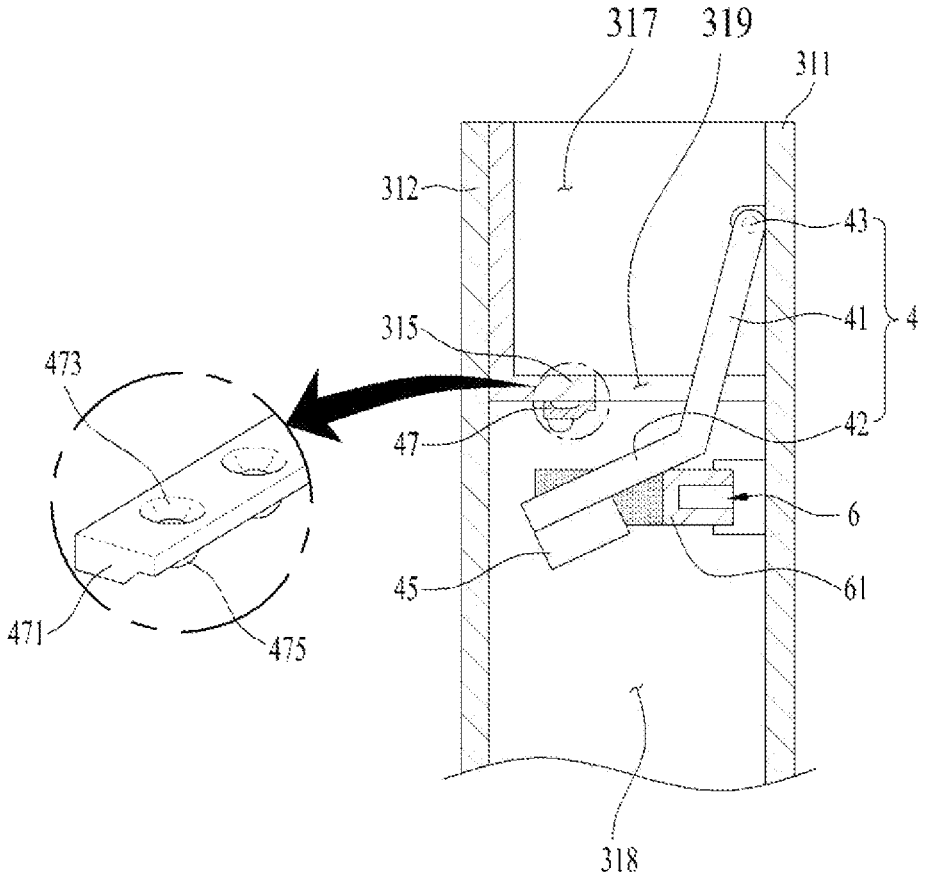
FIG. 2 shows an example of a switch and a damper in a laundry-treating apparatus according to the present disclosure.

As shown in FIG. 2, the door 3 includes a first receiving space 317 exposed outside the door, and a second receiving space 318 separated from the first receiving space 317 via a partitioning wall 315 and defined inside the door.

The actuator 4 may include a first body (or first handle link or extension) 41 pivotably received in the first receiving space 317, a second body (or second handle link or extension) 42 disposed within the second receiving space 318 and secured to the first body 41, and a movable portion (or handle extension) 45 disposed on the second body 42 for actuating a pivoting axis switch set 6 according to the pivot angle of the first body 41. The pivoting axis switch set 6 is disposed in the door body 31 to allow the user to change the pivoting axis (X, Y). A detailed description thereof will be described later.

A fixed end of the first body 41 is pivotably coupled to a hinge shaft 43 in the first receiving space 317. The first body 41 passes through a through-hole 319 defined in the partitioning wall. A free end of the first body is located within the second receiving space 318.

The second body 42 may be fixed to the free end of the first body 41. However, when the first body 41 pivots, the second body moves toward the pivoting axis switch 6. To this end, the second body 42 is bent toward the partitioning wall 315.

The movable portion 45 refers to means for pressing the pivoting axis switch set 6 when an external force is applied to the first body 41 and the second body 42 moves toward the outer frame 311. A detailed description thereof will be given later.

In the actuator 4 having the above-described structure, when the user pushes the first body 41 toward the outer frame 311 by hand (when an external force is inputted to the first body), the second body 42 moves toward the pivoting axis switch 6. Then, the movable portion 45 fixed to the second body will actuation the pivoting axis switch 6.

Figure 3:
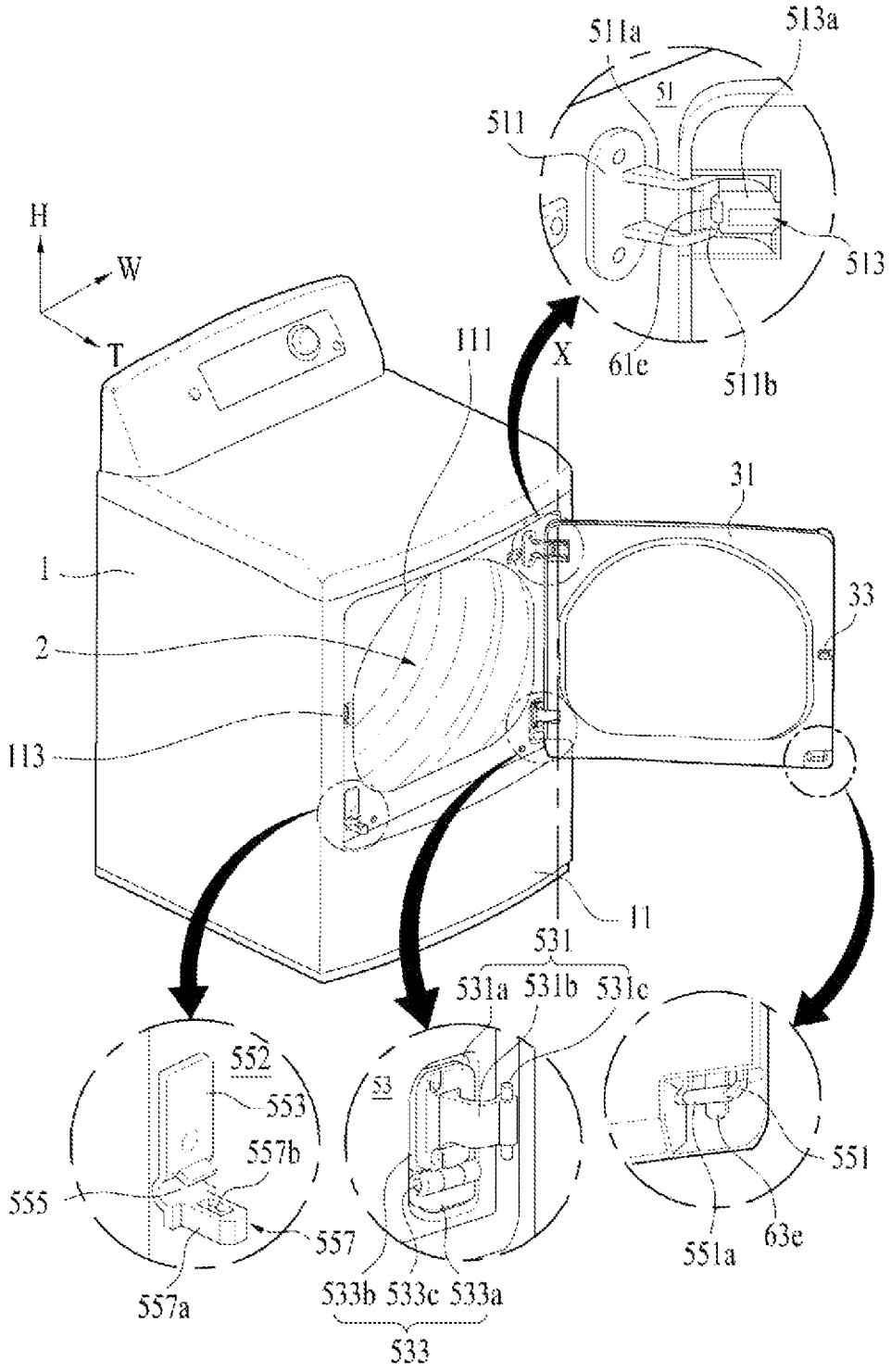
FIG. 3 shows a case when the door pivots about a first pivoting axis to open the laundry inlet.

As shown in FIG. 3, the hinge assemblies 51, 53 and 55 for coupling the door body 31 to the front panel 11 include a first hinge 51 having a first shaft 511*b*, a third hinge 551 and 552 having a fourth shaft 551*a*, and a second hinge 53 having a second shaft 531*c* defining a first pivoting axis X together with the first shaft 511*b*, and a third shaft 533*c* defining a second pivoting axis Y (see FIG. 1) together with the fourth shaft 551*a*.

The first hinge 51 may include a first hinge body 511 disposed on one of the front panel 11 and the door body 31. The first shaft 511*b* is fixed to the first hinge body 511. The first hinge 51 may further include a first shaft receiving structure (or recess) 513 which is disposed on the other of the front panel 11 and the door body 3. The first shaft 511 is detachably received in first shaft receiving structure 513.

FIG. 3 shows one example in which the first hinge body 511 is fixed to the front panel 11, and the first shaft receiving structure 513 is disposed on the door body 31. In this case, the first hinge body 511 includes a shaft support 511*a* supporting the first shaft 511*b*. The shaft support 511*a* may protrude from the front panel 11 and be bent in a direction parallel to the front panel and away from the laundry inlet 111. Alternatively, the shaft support 511*a* may merely protrude from the front panel 11.

Figure 4:
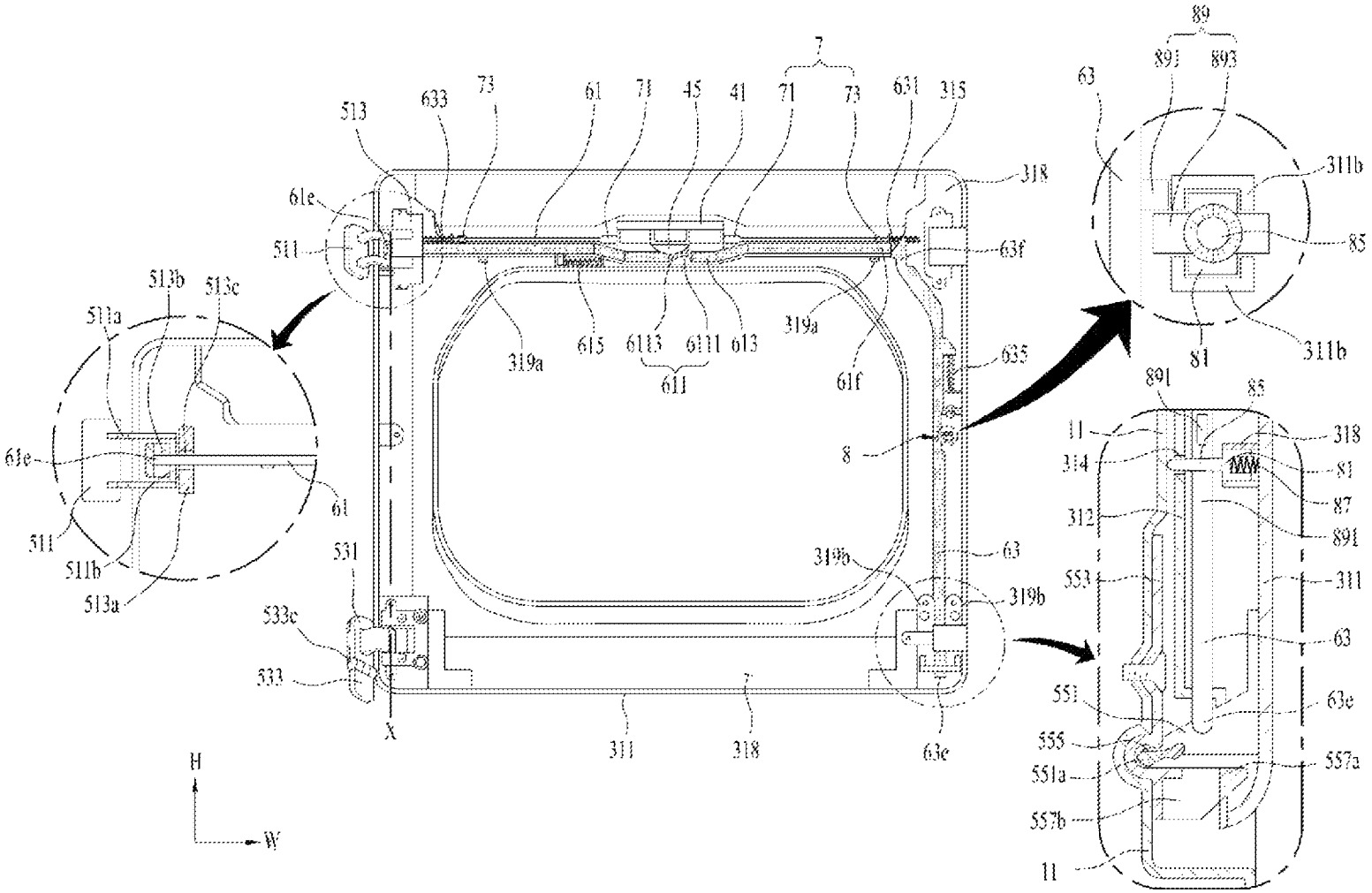
FIG. 4 and FIG. 5 show a pivoting axis switch, a first lock and a second lock as disposed inside the door.

As shown in FIG. 4, the first shaft receiving structure 513 includes a housing 513*a* fixed to the door body 31, and a first shaft receiving space 513*b* defined in the housing 513*a* to provide a space for accommodating the first shaft 511*b* therein. In this case, the first shaft receiving space 513*b* should be exposed to the outside of the inner frame 312.

In one example, the housing 513*a* is configured to have a switch through-hole 513*c* passing through the housing 513*a*. A first switch (or first arm or linkage or extension) 61 of the pivoting axis switch set 6 is inserted into the switch through-hole 513*c*. Therefore, when the first switch 61 reciprocates along the width direction W of the door body 31 by means of the actuator 4, a first free end 61*e* of the first switch may be exposed to the outside of the switch through-hole 513*c* to close the first shaft receiving space 513*b*. Alternatively, the first free end 61*e* of the first switch 61 may be located inside the switch through-hole 513*c* to open the first shaft receiving space 513*b*.

When the first shaft receiving space 513*b* is closed by the first free end 61*e* of the first switch, the first shaft 511*b* is prevented from being drawn out of the first shaft receiving space 513*b* or inserted into the first shaft receiving space 513*b*.

Figure 5:
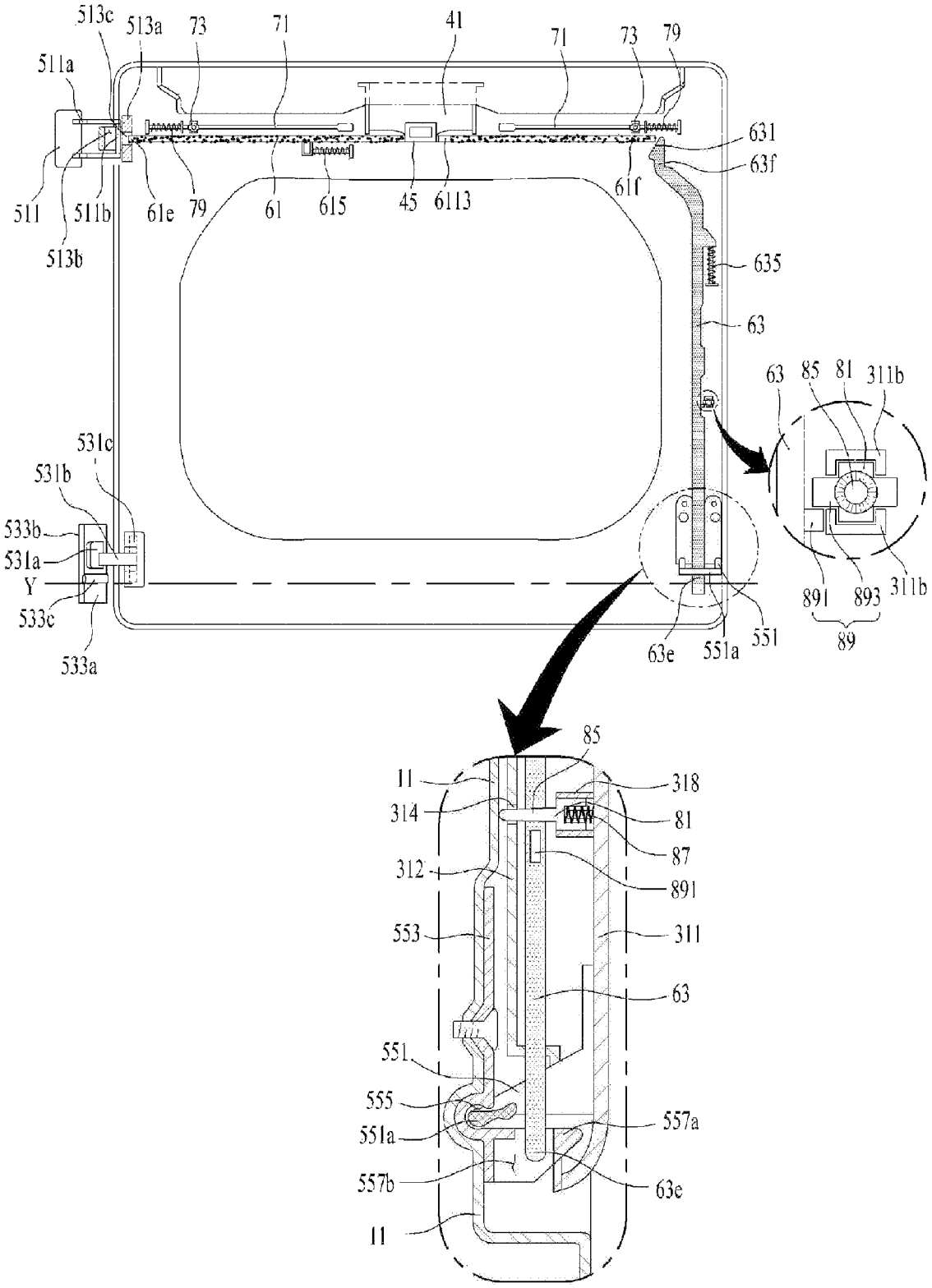

To the contrary, when the first shaft receiving space 513*b* is opened by the first free end 61*e* of the first switch, the first shaft 511*b* will either be withdrawn from the first shaft receiving space 513*b* or be insertable into the first shaft receiving space (see FIG. 5).

As shown in FIG. 3, the second hinge 53 may include a door support 531 having a second shaft 531*c*, and a cabinet hinge portion 533 for pivotably fixing the door support 531 to the front panel 11 via a third shaft 533*c*.

The cabinet hinge portion 533 may include a hinge body 533*a* secured to the front panel 11 and a pivotable plate 533*b* pivotably coupled to the hinge body 533*a* via the third shaft 533*c*.

In this case, the door support 531 may include a support body 531*a* fixed to the pivotable plate 533*b*, and a second shaft support 531*b* protruding from the support body 531*a* to support the second shaft 531*c*.

The second shaft 531*c* is pivotably coupled to the door body 31. The second shaft 531*c* is aligned with the first shaft 511*b* of the first hinge 51 in a linear manner. Thus, the first pivoting axis X is defined by the first shaft 511*b* and second shaft 531*c*.

The third hinge may include a fourth shaft 551*a* disposed on one of the door body 31 and the front panel 11, a fourth shaft receiving structure (or recess) 552 disposed on the other of the door body 31 and the front panel 11. The fourth shaft 551*a* is detachably received in the fourth shaft receiving structure 552. FIG. 3 shows an example in which the fourth shaft 551*a* is disposed on the door body 31 and the fourth shaft receiving structure 552 is disposed on the front panel 11.

The fourth shaft 551*a* is coupled to a third hinge body 551 fixed to the door body 31. The fourth shaft 551*a* supported on the third hinge body 551 is exposed to the outside of the inner frame 312.

The fourth shaft receiving structure 552 may include a body 553 secured to the front panel 11, a fourth shaft receiving space 555 defined in the body 553 and providing a space for receiving the fourth shaft 551*a*, and a switch receiving portion 557 extending from the body 553. A second switch (or second arm or linkage or extension) 63 of the pivoting axis switch set 6 to be described later is inserted into the switch receiving portion 557.

The fourth shaft receiving space 555 may be embodied as a groove formed by concavely bending the body 553. The fourth shaft receiving space 555 is aligned in parallel with (in the same straight line) the third shaft 533*c* of the second hinge 53. The fourth shaft 551*a* inserted in the fourth shaft receiving space 555 defines the second pivoting axis Y (see FIG. 1) together with the third shaft 533*c*.

The switch receiving portion 557 may include a receiving body 557*a* protruding from the body 553 and located below the fourth shaft receiving space 555, and a through-hole 557*b* penetrating the receiving body 557*a*. The through-hole 557*b* acts as a space for receiving therein a first free end 63*e* of the second switch 63 reciprocating along the height direction H of the door body 31. A detailed description thereof will be described later.

As shown in FIG. 4, the second receiving space 318 defined within the door body 31 accommodates therein pivoting axis switches 61 and 63 coupled to either the first pivoting axis X or the second pivoting axis Y of the door 3.

The pivoting axis switch set includes the first switch 61 reciprocating along the width direction W of the door body 31 by means of the actuator 4, and the second switch 63 reciprocating along the height direction H of the door body 31 by means of the first switch 61.

The first switch 61 may embodied as a bar located above the laundry inlet 111. In this case, the first free end 61*e* of the first switch 61 passes through the housing 513*a* via the switch through-hole 513*c*. The second free end 61*f* of the first switch 61 is configured to contact the second free end 63*f* of the second switch 63 (that is, fourth free end).

The first switch 61 is supported by a first switch guide 319*a* disposed on at least one of the outer frame 311 or the inner frame 312. FIG. 4 shows an example in which the first switch guide 319*a* is disposed on the outer frame 311 to guide the movement of the first switch 61.

The first switch 61 includes a contact 611. The contact 611 may act to contact the movable portion 45 when pivoting the first body 41 and to move the first switch 61 toward the second switch 63 (in the right direction of FIG. 4).

To this end, the contact 611 may include a contact body 6111 protruding from the first switch 61 toward the inner frame 312, and an inclined face 6113 disposed on the contact body and contacting the movable portion 45. In this case, the inclined face 6113 may be configured to have an upward slope as the face 6113 extends toward the second free end 61*f* from the first free end 61*e* of the first switch.

Thus, when the user presses the first body 41 of the actuator, the movable portion 45 presses the inclined face 6113. Thus, the user may move the first switch 61 toward the second switch 63 using the actuator 4. That is, in accordance with the present disclosure, the user may manipulate the actuator 4 to cause the first free end 61*e* of the first switch to open the first shaft receiving space 513*a*.

In one example, since the contact 611 must be disposed in the door body 31 with a limited thickness, the first switch 61 may be further provided with a bent portion 613 bent toward the outer frame 311. In this case, the contact 611 is preferably coupled to the bent portion 613.

The second switch 63 may be embodied as a bar extending along the height direction H of the door body 31. A first free end 63*e* (that is, a third free end) of the second switch 63 is located in the space between the fourth shaft 551*a* and the outer frame 311. A second free end 63*f* (a fourth free end) of the second switch 63 contacts the second free end 61*f* of the first switch 61.

In order to facilitate the transmission of the external force input to the first switch 61 from the actuator 4 to the second switch 63, one of the second free end 61*f* of the first switch and the second free end 63*f* of the second switch may have a switch inclined face 631. FIG. 4 shows an example where the switch inclined face 631 is formed on the second switch 63.

The second switch 63 is supported by a second switch guide 319*b* disposed on at least one of the outer frame 311 and the inner frame 312. FIG. 4 shows an example in which the second switch guide 319*b* is disposed on the outer frame 311 to guide the movement of the second switch 63.

In one example, in order that, when the door 3 closes the laundry inlet 111, the door 3 may remain coupled to the first pivoting axis X, the pivoting axis switch set 6 may further comprise an elastic support set 615 and 635 for urging the first switch 61 toward the first shaft receiving structure 513.

The elastic support set may include only a second elastic member 635 that supplies a restoring force to the second switch 63. Alternatively, the elastic support set may include the second elastic member 635 and a first elastic member 615 that supplies a restoring force to the first switch 61.

The second elastic member 635 is configured to supply a force to move the first free end 63*e* of the second switch 63 in a direction away from the switch receiving portions 557*a* and 557*b*. The first elastic member 615 is configured to supply a force to move the first free end 61*e* of the first switch 61 to close the first shaft receiving space 513*b*.

Thus, when the first switch 61 does not move in a direction to press the second switch 63 by means of the actuator 4 (when the user does not manipulate the actuator), the first free end 63*e* of the second switch 63 will be kept in a drawn state from the through-hole 557*b*.

When the first free end 63*e* of the second switch is kept in a drawn state from the through-hole 557*b* by means of the second elastic member 635, the second free end 61*f* of the first switch 61 is urged toward the first shaft receiving structure 513 by means of the second free end 63*f* of the second switch 63. Thus, the first shaft 511*b* may be prevented from being drawn out of the first shaft receiving space 513*b* by means of the first free end 61*e* of the first switch.

Thus, in accordance with the present disclosure, when no external force is applied to the actuator 4 while the door 3 closes the laundry inlet 111, the door 3 will remain pivotable around the first pivoting axis X.

The configuration that when the door 3 closes the laundry inlet 111, the door 3 remains pivotable around the first pivoting axis X may prevent the door from opening the laundry inlet due to the weight of the door itself.

Otherwise, while the door closes the laundry inlet, the door remains pivotable around the second pivoting axis Y. In this case, a direction of gravity acting on the door and the pivoting direction of the door around the second pivoting axis Y are the same. Thus, the door may pivot about the second pivoting axis Y. However, the configuration that when the door 3 closes the laundry inlet 111, the door 3 remains pivotable around the first pivoting axis X may remove this problem.

The second elastic member 635 may include a spring having one end fixed to the second switch 63 and the other end fixed to one of the outer frame 311 and the inner frame 312. Similarly, the first elastic member 615 may include a spring having one end fixed to the first switch 61 and the other end fixed to either the outer frame 311 or the inner frame 312.

Hereinafter, the process of changing the pivoting axis (X, Y) of the door 3 will be described with reference to FIGS. 4 to 5.

As shown in FIG. 4, when the door 3 closes the laundry inlet 111 (the door body 31 contacts the front panel 11, and no external force is input to the first body 41), the first switch 61 is urged toward the first hinge assembly 51 by means of the elastic supports 615 and 635. Thus, the first free end 61*e* of the first switch prevents the first shaft 511*b* from being drawn out of the first shaft receiving space 513*b*.

At this time, the fourth shaft 551*a* remains in an inserted state into the fourth shaft receiving space 555 while the first free end 63*e* of the second switch 63 is not inserted into the through-hole 557*b*. This is because that, unless the first switch 61 is moved away from the first hinge 51 (in the right direction of FIG. 4) by means of the actuator 4, the second switch 63 is not inserted into the through-hole 557*b*. Thus, when the door 3 closes the laundry inlet 111, the door 3 is pivotable around the first pivoting axis X defined by the first shaft 511*b* and second shaft 531*c*.

At this time, when the user puts his/her hand into the first receiving space 317 (see FIG. 2) and pulls the door body 31 in a direction away from the front panel 11 (when the user pulls the door body without pressing the first body 41), the door 3 will pivot around the first pivoting axis X to open the laundry inlet 111 (see FIG. 3).

Alternatively, when the user presses the first body 41 while the door 3 closes the laundry inlet 111, the first switch 61 and the second switch 63 operate in a manner as shown in FIG. 5. That is, when the user presses the first body 41, the movable portion 45 presses the inclined face 6113 disposed in the contact 611 such that the first switch 61 is moved toward the second switch 63.

When the first switch 61 moves toward the second switch 63, the first free end 61*e* of the first switch moves to open the first shaft receiving space 513*b*. Thus, the second free end 61*f* of the first switch presses the switch inclined face 631 of the second switch 63. Thus, the first shaft 511*b* is ready to be drawn out from the first shaft receiving space 513*b*. The first free end 63*e* of the second switch is inserted into the through hole 557*b* of the third hinge 55 to prevent the fourth shaft 551*a* from being separated from the fourth shaft receiving space 555.

That is, when the door 3 has closed the laundry inlet 111 and the user presses the body 41, the door 3 is pivotable about the second pivoting axis Y defined by the fourth shaft 551*a* and the third shaft 533*c*.

At this time, when the user pulls the door body 31 in a direction away from the front panel 11 while pressing the first body 41, the door 3 pivots around the second pivoting axis Y and opens the laundry inlet 111 (as shown in FIG. 1).

In the laundry-treating apparatus 100 as described above, the first pivoting axis X may be implemented as a vertical axis perpendicular to the bottom surface of the cabinet, while the second pivoting axis Y may be implemented as a horizontal axis parallel to the bottom of the cabinet. However, the present disclosure is not limited thereto. The first pivoting axis X and the second pivoting axis Y may be configured in an opposite manner to the above-described configuration.

In one example, in the laundry-treating apparatus 100 having only the structure described above, when the door 3 pivots around the first pivoting axis X and when the user presses the first body 41 and inputs an external force to the handle, the first shaft 511*b* may be separated from the first shaft receiving structure 513.

Further, in the laundry-treating apparatus 100 having the above-described structure, when the door 3 pivots around the second pivoting axis Y, the first body 41 must be kept at a pressed state to prevent the first free end 63*e* of the second switch from being drawn out from the through-hole 557*b*, that is, to prevent the fourth shaft from being drawn out from the fourth shaft receiving space.

In order to solve the above-mentioned disadvantages, the laundry-treating apparatus 100 according to the present disclosure may further include locking means 7 and 8. When the door 3 opens the laundry inlet 111, that is, when the door body is detached from the front panel, the locking means 7 and 8 fix the position of the first switch 61 and second switch 63.

FIG. 4 and FIG. 5 shows an example in which the locking means includes both a first lock 7 that locks the position of the first switch 61 and a second lock 8 that locks the position of the second switch 63.

Figure 6:
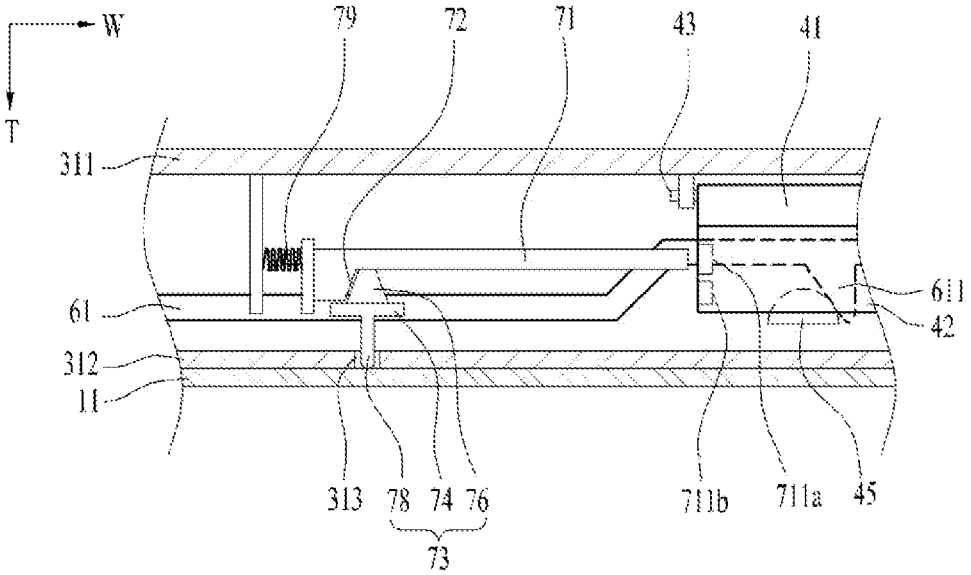
FIG. 6 and FIG. 7 illustrate an example of first and second locks.

As shown in FIG. 6, the first lock 7 may include a first lock body (or lock link or bar or extension) 71 detachably mounted on the actuator 4, and a first movable lock portion 73 for allowing the first lock body 71 to reciprocate along a width direction W of the door 3 inside the door body 31.

The first lock body 71 may be embodied as a bar. The first lock body 71 may be pressed by a first lock support 79 toward the second body 42. The first lock support 79 may include a spring for urging a free end of the first lock body 71 toward the second body 42.

The first lock body 71 has a first inclined lock face 72 which is urged by the first movable lock portion 73. The first inclined lock face 72 may have an upwards slope as it goes away from the actuator 4.

When the door 3 closes the laundry inlet 111, the first movable lock portion 73 moves the first lock body 71 in a direction away from the second body 42. When the door 3 opens the laundry inlet 111, the first movable lock portion 73 moves the first lock body 71 toward the second body 42.

To this end, the first movable lock portion 73 may include a movable body 74 which reciprocates along the thickness direction T of the door 3, and pressing means 76 and 78 for separating the first lock body 71 from the second body 42 upon contacting the front panel 11.

The pressing means may include first pressing means 76 fixed to the movable body 74 and passing through the inner frame 312, and second pressing means 78 fixed to the movable body 74 and contacting the first inclined lock face 72. In this case, the inner frame 312 may further include a first through-hole 313 into which the first pressing means 76 is inserted.

The first movable lock portion 73 may be fixed to the front panel 11, unlike the manner as shown in the drawing. In this case, when the door 3 closes the laundry inlet 11, the first movable lock portion 73 may be configured to be inserted into the first through-hole 313 to press the first inclined lock face 72.

In one example, the first lock body 71 may be coupled to the second body 42 via a first lock catch 711. In this case, the first lock catch 711 may include a first stopper 711*a* and a second stopper 711*b* disposed on the second body 42 and receiving the free end of the first lock body 71.

When the user pivots the door 3 without pressing the first body 41, that is, when the door pivots around the first pivoting axis, the first lock body 71 is coupled to the first stopper 711*a*. When the user presses the first body 41 and pivots the door 3, that is, when the door pivots about the second pivoting axis, the first lock body 71 is coupled to the second stopper 711*b*.

Figure 7:
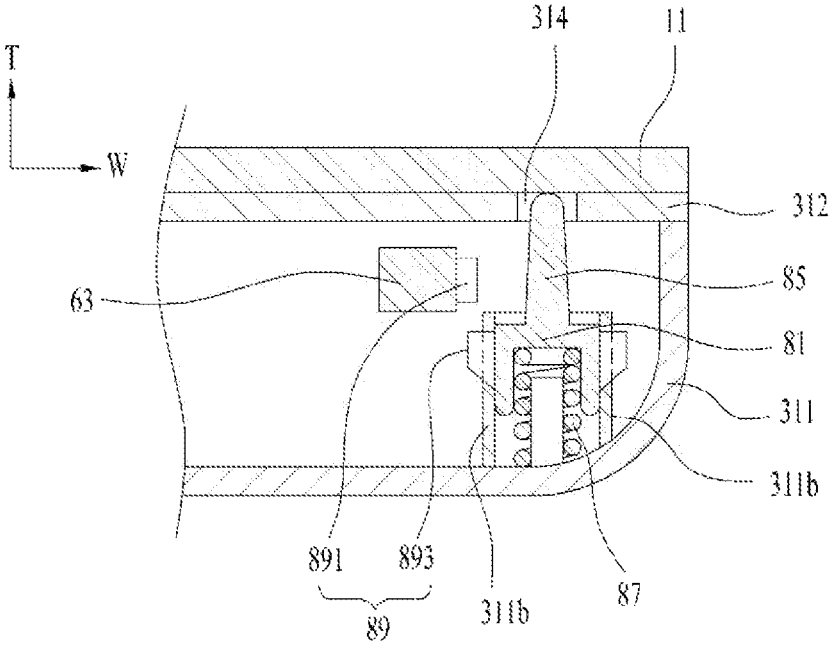
Figure 7:
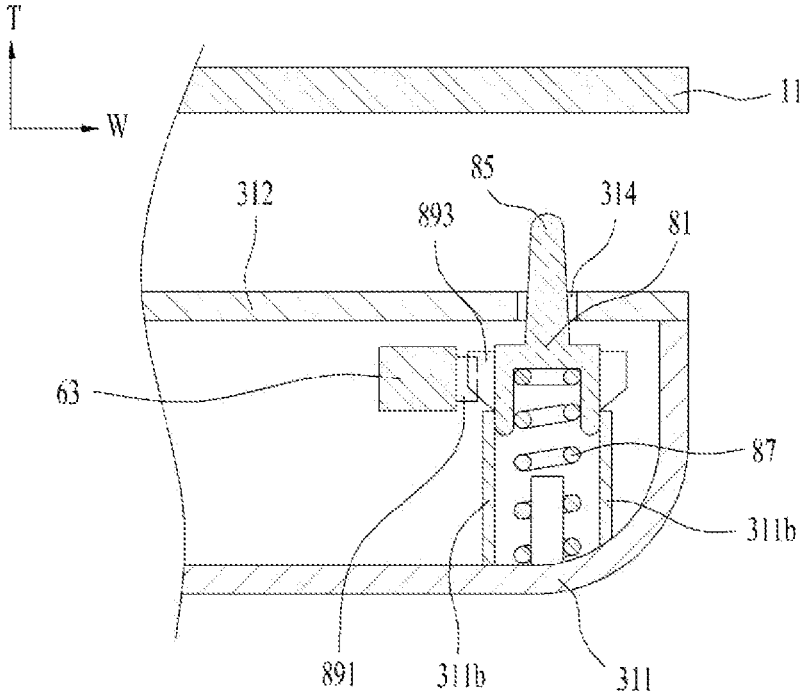

As shown in FIG. 7, the second lock 8 may include a second lock body (or second lock link or bar or extension) 81 which reciprocates within the door 3 along the thickness direction T of the door 3, a second lock support 87 that provides a restoring force to the second lock body 81, a second movable lock portion 85 that moves the second lock body 81 in a direction away from the front panel 11 when the door 3 closes the laundry inlet, and a second lock catch 89. When the door 3 closes the laundry inlet 11, the second lock catch 89 separates the second lock body 81 from the second switch 63. When the door 3 opens the laundry inlet 11, the second lock catch 89 connects the second lock body 81 to the second switch 63.

The second lock body 81 reciprocates inside the door 3 under a guidance of a second guide 318 disposed on the door 3. The second lock support 87 may include a spring connecting the second lock body 81 and the door body 31. In this case, the second lock support 87 is preferably configured to press the second lock body 81 toward the inner frame 312 (towards the laundry inlet).

The second movable lock portion 85 may be fixed through the inner frame 312 to the second lock body 81. In this case, the inner frame 312 should have a second through-hole 314 defined therein through which the second movable lock portion 85 passes.

In an alternative, the second movable lock portion 85 may be fixed to the front panel 11. In this case, the second movable lock portion 85 should be configured to be inserted into the second through-hole 314 to press the second lock body 81 when the door 3 closes the laundry inlet 111.

The second lock catch 89 may include a first stopper 891 disposed on the second switch 63, and a second stopper 893 disposed on the second lock body 81 and removably mounted on the first stopper 891.

The second lock catch 89 may be configured in any form as long as it can implement the above function. FIG. 7 shows one example that the first stopper 891 protrudes from an outer peripheral surface of the driven body 651 and the second stopper 893 protrudes from an outer circumferential surface of the second lock body 81.

An actuation process of the door 3 using the locking means 7 and 8 disposed will be described below.

When the door body 31 closes the laundry inlet 111 as shown in FIG. 4, the first movable lock portion 73 and the second movable lock portion 85 are kept at the pressed state by the front panel 11. Thus, the first lock body 71 maintains a state (FIG. 6) in which the first lock body 71 is separated from the actuator 4. The second stopper 893 of the second lock body 81 maintains a state (FIG. 10*a*) in which the second stopper 893 is separated from the first stopper 891.

In this state, when the user does not press the first body 41 and when the door body 31 is detached from the front panel 11 by the user (when pivoting the door body around the first pivoting axis X), the external force input to the first movable lock portion 73 and the second movable lock portion 85 via the front panel 11 disappears. Thus, the first lock body 71 is coupled to the first stopper 711*a* to prevent the first body 41 from pivoting. The second lock body 81 prevents the second stopper 893 from rising to a lateral face of the first stopper 891 and thus prevents the second switch 63 from moving toward the fourth shaft 551*a* (See FIG. 7*b*).

When the pivoting of the second body 42 is prevented by the first stopper 711*a*, the first switch 61 may not move even when an external force is applied to the first body 41 while the door body 31 pivots around the first pivoting axis X. Accordingly, in accordance with the present disclosure, even when an external force is applied to the actuator 4 while the door body 31 pivots around the first pivoting axis X, the first shaft 511*b* may be prevented from being drawn out from the first shaft receiving space 513*b*.

In one example, when the door body 31 pivots about the first pivoting axis X, the first movable lock portion 73 may be pressed by the user or an object to switch the first body 41 into a pivotable state. This may be problematic. However, according to the present disclosure, the second lock 8 may prevent the first shaft 511*b* from being drawn out from the first shaft receiving space 513*b*.

Suppose that there is no second lock 8. When the first movable lock portion 73 is pushed by a user or other object while the door body 31 pivots about the first pivoting axis X, the first lock body 71 will be separated from the first stopper 711*a* of the actuator 4. At this time, when the user presses the first body 41, the first free end 61*e* of the first switch will open the first shaft receiving space 513*b*. Thus, there may be a problem that the door body 31 is separated from both the first pivoting axis X and the second pivoting axis Y (that is, the first shaft may be separated from the first shaft receiving space, while the fourth shaft may be separated from the fourth shaft receiving space).

However, in accordance with the present disclosure, when the door body 31 is separated from the front panel 11, the second switch 63 is prevented from moving toward the through-hole 557*b* by means of the second lock 8. Thus, the movement of the first switch 61 supported on the second free end 63*f* of the second switch is also prevented.

Accordingly, in accordance with the present disclosure, even when an external force is input to the first movable lock portion 73 while the door body 31 pivots about the first pivoting axis X, the second lock 8 may prevent the door body 31 from being disengaged from the first shaft 511*b*.

As shown in FIG. 5, when the user presses the first body 41 and detaches the door body 31 from the front panel 11 (when pivoting the door about the second pivoting axis Y), the first free end 63*e* of the second switch is inserted into the through-hole 557*b* to prevent the fourth shaft 551*a* from being drawn out of the fourth shaft receiving space 555.

Further, since the first movable lock portion 73 and the second movable lock portion 85 are separated from the front panel 11, the first lock body 71 is coupled to the second stopper 711*b* to prevent the first body 41 from pivoting. The second lock body 81 prevents the second stopper 893 from rising to a side face of the first stopper 891 and thus prevents the second switch 63 from moving toward the second free end 61*f* of the first switch 61.

When the first lock body 71 is coupled to the second stopper 711*b*, the first body 41 may be maintained at a pivotable state. Accordingly, in accordance with the present disclosure, even when the user does not keep the first body 41 at the pressed state while the door body 31 pivots around the second pivoting axis Y, the fourth shaft 551*a* may be prevented from being pulled out of the fourth shaft receiving space 555.

In one example, the door 3 may have only the first lock 7. In this case, when the first movable lock portion 73 is pushed while the door body 31 pivots about the second pivoting axis Y, the fourth shaft 551*a* may be disengaged from the fourth shaft receiving space 555. This may be problematic. However, in accordance with the present disclosure, the above problem may be avoided using the second lock 8.

Suppose that there is no second lock 8. When the first movable lock portion 73 is pushed by the user or other object while the door body 31 pivots about the second pivoting axis Y, the first lock body 71 will separate from the second stopper 711*b* of the second body 42.

When the first lock body 71 is separated from the second stopper 711*b*, the external force input to the contact 611 of the first switch 61 via the movable portion 45 of the actuator 4 disappears. Thus, the first free end 61*e* of the first switch 61 will move toward the first shaft receiving structure 513 by means of the elastic supports 615 and 635. Thus, the first free end 63*e* of the second switch 63 will be withdrawn from the through-hole 557*b* so that the fourth shaft 551*a* may be disengaged from the fourth shaft receiving space 555.

However, according to the present disclosure, when the door body 31 pivots about the second pivoting axis Y, the second lock 8 prevents the first free end 63*e* of the second switch from being pulled out of the receiving space through-hole 557*b*. Accordingly, in accordance with the present disclosure, even when an external force is input to the first movable lock portion 73 while the door body 31 pivots about the second pivoting axis Y, the fourth shaft 551*a* may be prevented from being separated from the fourth shaft receiving space 555.

In conclusion, for the door 3 with both the first lock 7 and second lock 8, only when an external force is simultaneously inputted to the first movable lock portion 73 and the second movable lock portion 85, the pivoting axis (X, Y) may be switched. Thus, the door body 31 is not separated from the first hinge assembly 51 and the third hinge assembly 55 at the same time when an external force is input to one of the lock movable portions during the pivoting of the door body 31.

Figure 8:
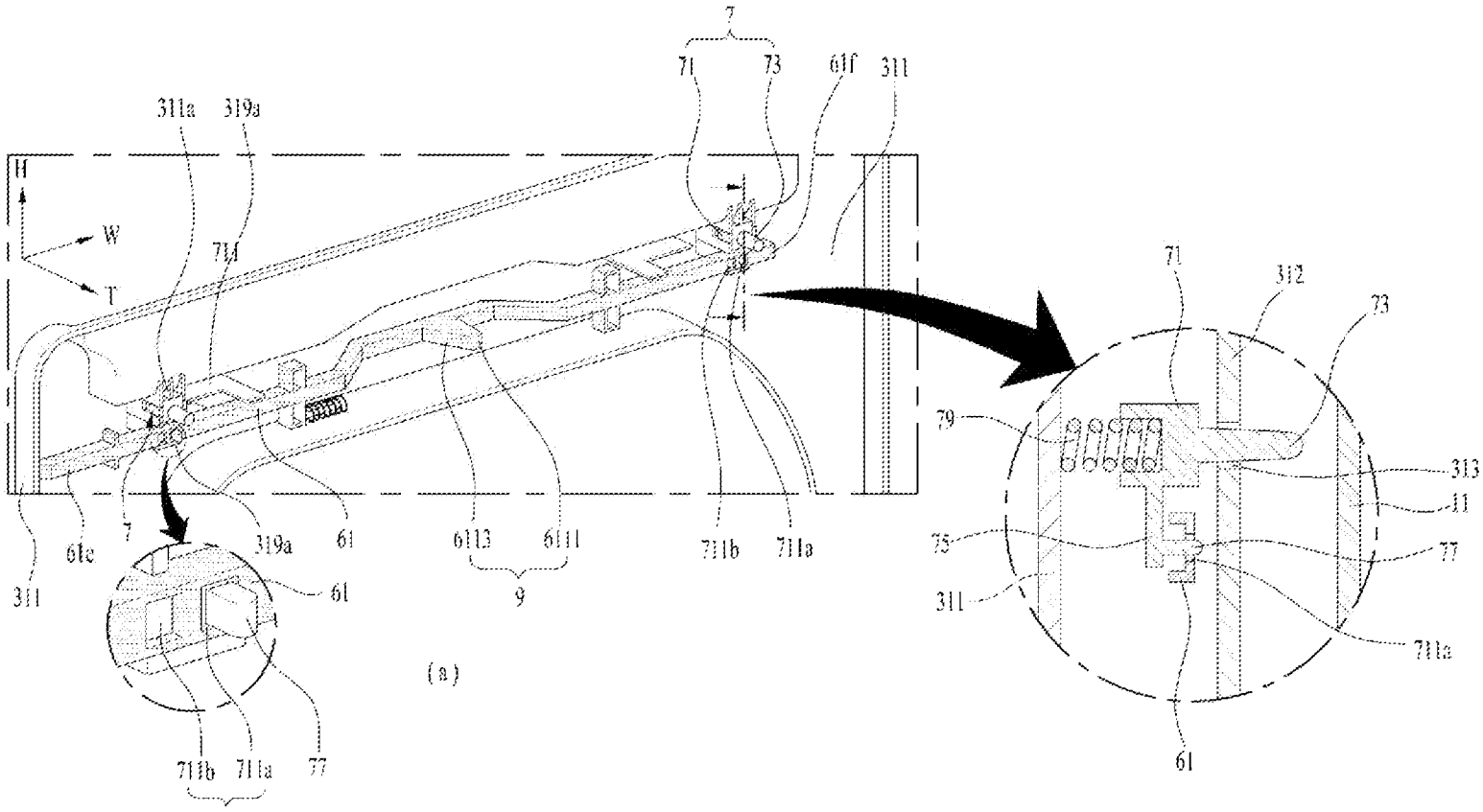
FIG. 8 and FIG. 9 illustrate another embodiment of a first lock and a second lock according to the present disclosure.

FIG. 8 illustrates another embodiment of a first lock 7, wherein the first lock according to the present embodiment is coupled to the first switch 61 when the door 3 opens the laundry inlet, whereas the first lock is separated from the first switch 61 when the door closes the laundry inlet.

In this embodiment, the first lock 7 includes a first lock body 71 which reciprocates along the thickness direction T of the door, a first lock support 79 which presses the first lock body 71 toward the inner frame 312 and supplies a restoring force to the first lock body, an extension 75 extending from the first lock body 71 toward the first switch 61, a lock protrusion 77 protruding from the extension toward the first switch 61, a first lock catch 711 disposed on the first switch 61 to receive the lock protrusion 77 therein, and a first movable lock portion 73 which contacts the front panel 11 when the door 3 closes the laundry inlet 111, and moves the first lock body 71 in a direction away from the first switch 61.

The first lock body 71 reciprocates inside the door 3 under the guidance of the first guide 311*a* disposed on the outer frame 311.

The first movable lock portion 73 protrudes from the first lock body 71 and is exposed to the outside of the door body 31 through a through-hole 313 defined in the inner frame 312.

The first lock catch 711 may include a first stopper 711*a* and a second stopper 711*b* that are spaced apart from each other in the longitudinal direction W of the first switch 61.

In this embodiment, when the lock protrusion 77 is inserted into the first stopper 711*a*, the first shaft 511*b* is prevented from separating from the first shaft receiving space 513*b*. When the lock protrusion 77 is inserted into the second stopper 711*b*, the fourth shaft 551*a* will be prevented from being drawn out from the fourth shaft receiving space 555.

Figure 9:
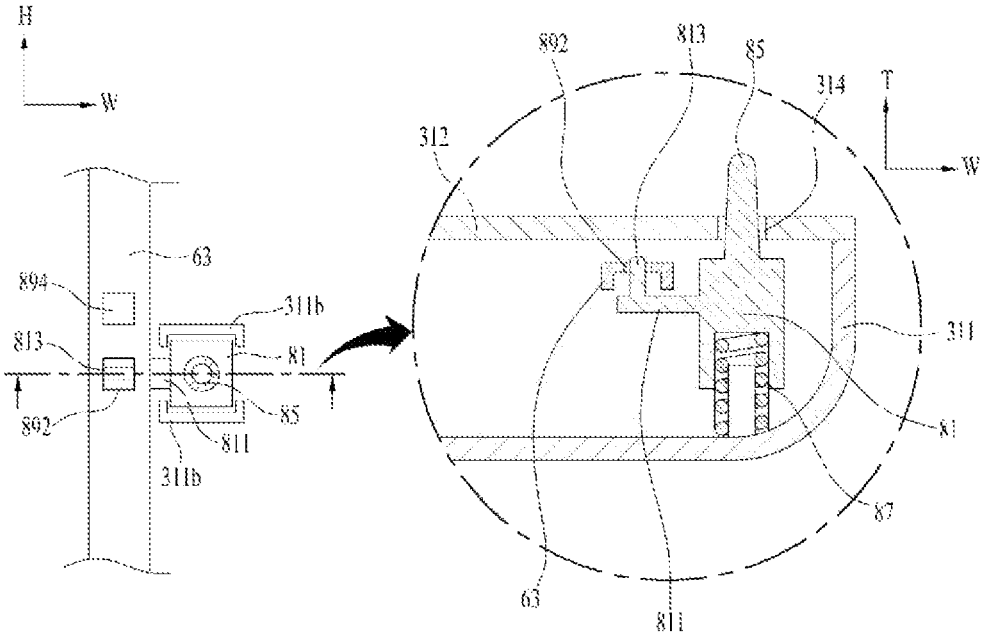

FIG. 9 shows another embodiment of a second lock 8.

The second lock 8 according to this embodiment may include a second lock body 81 reciprocating along the thickness direction T of the door, a second lock support 87, which supplies restoring force to the second lock body, a second lock extension 811 extending from the second lock body toward the second switch 63, a second lock protrusion 813 protruding from the second lock extension toward the second switch, a second lock catch 892 and 894 disposed on the second switch 63 to accommodate the second lock protrusion therein, and a second movable lock portion 85 which contacts, when the door closes the laundry inlet, the front panel 11 to move the first lock body away from the second switch.

The second lock body 81 reciprocates inside the door 3 by the guidance of a second guide 311*b* disposed on the outer frame 311.

In this case, the second lock catch has a first receiving hole 892 and a second receiving hole 894 which are spaced apart from each other along the longitudinal direction H of the second switch 63, and which pass through the second switch.

In this embodiment, when the second lock protrusion 813 is inserted into the first receiving hole 892, the first shaft 511*b* is prevented from separating from the first shaft receiving space 513*b*. When the second lock protrusion 813 is inserted into the second receiving hole 894, the fourth shaft 551*a* will be prevented from being drawn out from the through-hole 557*b*.

As shown in FIG. 2, in the laundry-treating apparatus 100 having the above-described structure, then actuator 4 returns to its initial position, the second body 42 collides against the partitioning wall 315. Thus, the partitioning wall 315 or second body 42 may break or generate the noise.

In particular, in the laundry-treating apparatus 100 according to the present disclosure, there are the first lock 7 and second lock 8 which fix the position of the pivoting axis switches 61 and 63 when the door 3 opens the laundry inlet 111, and which returns the pivoting axis switches 61 and 63 to the initial positions when door 3 closes the laundry inlet 111. Thus, the risk as described above may become even greater when the door 3 switches from a state in which the door has pivoted about the second pivoting axis Y to open the laundry inlet 111 to a state in which the door 3 closes the laundry inlet 111.

In order to solve the problems such as the noise generated when the door 3 closes the laundry inlet 111, the laundry-treating apparatus according to the present disclosure may further include a damper.

The damper 47 (first damper) shown in FIG. 2 prevents the second body from colliding against the partitioning wall as the second body 42 of the actuator 4 moves towards the partitioning wall 315.

The first damper 47 may include an elastic body 471 secured to either the partitioning wall 315 or the second body 42. The elastic body is preferably embodied as an elastic member such as rubber.

In one example, the damper 47 may further include at least one of a protrusion 475 extending from a face of the elastic body 471 to be in contact with the second body 42, and a groove 473 defined in a face of the elastic body 471 facing the partitioning wall 315.

The protrusion 475 or the groove 473 may easily absorb the kinetic energy of the second handle body 42 when the door closes the laundry inlet 111 and thus the second handle body 42 moves toward the partitioning wall 315. Thus, the protrusion 475 or the groove 473 may effectively prevent the collision between the second handle body 42 and the partitioning wall 315.

Figure 10:
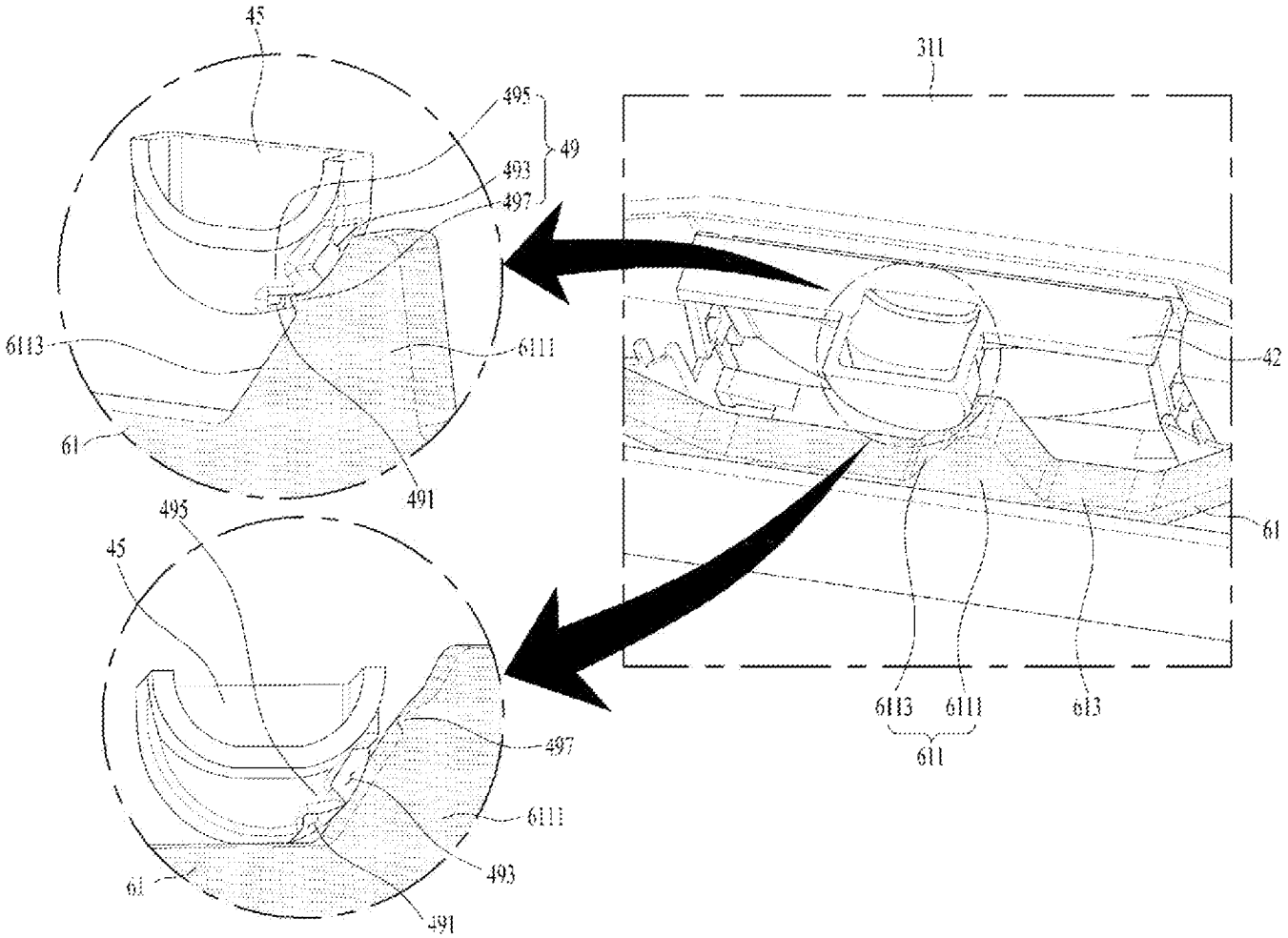
FIG. 10 shows another embodiment of a damper according to the present disclosure.

FIG. 10 shows another embodiment of a damper according to the present disclosure. A second damper 49 according to the present embodiment includes a groove defined in one of the movable portion 45 disposed on the second body 42 and the contact 611 disposed on the first switch 61, a first protrusion 495 which divides the groove into a first groove 491 and a second groove 493, and a second protrusion 497 which is disposed on the other of the movable portion and the contact and which reciprocates between the first groove and the second groove according to the position of the first switch 61. The second protrusion 497 is constructed to interfere with the first protrusion 495 when reciprocating between the first groove 491 and the second groove 493.

In the second damper 49 having the above structure, when the first switch 61 is in a position to couple the door to the first pivoting axis X, the second protrusion 497 is located at the first groove 491. However, when the user presses the first body 41 of the actuator 4 and places the first switch 61 in a position to separate the door from the first pivoting axis X, the second protrusion 497 is located at the second groove 493. That is, when an external force is applied to the actuator 4 and the door pivots about the second pivoting axis Y, the second protrusion 497 is located inside the second groove 493 or outside the second groove 493.

When the door 3 closes the laundry inlet 111 in this state, the first lock 7 is disconnected from the first switch 61 and the second lock 8 is separated from the second switch 63. Thus, each switch 61 and 63 will return to its initial position.

When the first switch 61 returns to its initial position (when the first switch moves in the direction of closing the first shaft receiving space), the second protrusion 497 moves from the second groove 493 toward the first groove 491. In this process, the protrusion 497 may collide with the first protrusion 495.

When the second protrusion 497 collides with the first protrusion 495 while moving from the second groove 493 to the first groove 491, the pivoting speed of the second body 42 of the switch will decelerate. Thus, the second damper 49 reduces the pivoting speed of the second body 42, thereby minimizing the noise as generated during the collision between the partitioning wall 315 and the second body 42.

The present disclosure may be embodied in various forms without departing from the scope of the invention. Therefore, when modified embodiments include elements recited claims according to the present disclosure, the modified embodiments should be regarded as belonging to the scope of the present disclosure.

What is claimed is:

1. A laundry-treating apparatus comprising:

a cabinet having an inlet defined therein;

a door provided to open and close the inlet, wherein the door includes a first receiving space defined therein and exposed to an outside, and a second receiving space defined therein and separated from the first receiving space by a partitioning wall;

a first linkage configured to reciprocate within the second receiving space, wherein the first linkage is configured to move to selectively connect the door to pivot about a first pivoting axis;

a second linkage configured to reciprocate within the second receiving space, wherein when the first linkage moves to separate the door from the first pivoting axis, the second linkage is configured to connect the door to pivot about a second pivoting axis that differs from the first pivoting axis;

a handle including:

a first handle link having a first end pivotably coupled to the door in the first receiving space and a second end located in the second receiving space, wherein the first handle link passes through the partitioning wall;

a second handle link fixed to the second end of the first handle link and located inside the second receiving space, wherein when a force is applied to move the first handle link, the second handle link moves the first linkage so that the door is separated from the first pivoting axis, and wherein when the first linkage moves to connect the door at the first pivoting axis, the second handle link moves toward the partitioning wall; and a damper provided between the second handle link and the partitioning wall, wherein the damper includes elastic that is fixed to one of the partitioning wall or the second handle link to prevent the second handle link from colliding with the partitioning wall.

2. The laundry-treating apparatus of claim 1, wherein the damper includes a protrusion extending from a face of the damper and toward the second handle link.

3. The laundry-treating apparatus of claim 1, wherein the damper includes a groove concavely defined in a face of the damper in contact with the partitioning wall.

4. The laundry-treating apparatus of claim 1, further comprising:

an extension in the second handle link; and a contact surface included in the first linkage, wherein when the contact surface is pressed by the extension, the first linkage moves to separate the door from the first pivoting axis.

5. The laundry-treating apparatus of claim 4, wherein the damper includes:

a groove provided in one of the extension or the contact surface;

a first protrusion to divide the groove into a first groove and a second groove;

a second protrusion extending from another one of the extension or the contact surface, wherein the second protrusion reciprocates between the first groove and the second groove, and wherein the second protrusion interferes with the first protrusion when reciprocating between the first groove and the second groove.

6. The laundry-treating apparatus of claim 5, wherein when the first linkage is in a position to couple the door at the first pivoting axis, the second protrusion is configured to be located in the first groove, wherein when the first linkage is in a position to separate the door from the first pivoting axis, the second protrusion is configured to be located in the second groove.

7. The laundry-treating apparatus of claim 1, further comprising:

a first hinge including:

a first shaft provided at one of the cabinet or the door and defining the first pivoting axis for the door; and a first recess on another one of the cabinet or the door that does not include the first shaft, wherein the first recess is configured to receive the first shaft therein;

a second hinge including:

a second shaft coupled to the door, wherein the first and second shafts axially extend along the first pivoting axis; and a third shaft configured to pivotably fix the second shaft to the cabinet;

a third hinge including:

a fourth shaft provided on one of the cabinet or the door, wherein the third and fourth shafts extend axially along the second pivoting axis; and a second recess provided on another one of the cabinet or the door that does not include the fourth shaft, wherein the second recess receives the fourth shaft therein, wherein the first linkage is configured to open and close the first recess, wherein the second linkage is configured to open and close the second recess, and wherein when the first linkage moves to open the first recess, the second linkage is configured to move to close the second recess.

8. The laundry-treating apparatus of claim 7, further comprising:

an elastic support to press the first linkage toward the first recess such that the door moves on the first pivoting axis when the door closes the inlet.

9. The laundry-treating apparatus of claim 1, further comprising a first lock that selectively engages the first linkage when the door opens or closes the inlet.

10. The laundry-treating apparatus of claim 9, wherein the first lock is configured to be separated from at least one of the first handle link or the second handle link when the door closes the inlet, and wherein the first lock is configured to be coupled to the at least one of the first handle link or the second handle link when the door opens the inlet.

11. The laundry-treating apparatus of claim 9, wherein the first lock is configured to be separated from the first linkage when the door closes the inlet, and wherein the first lock is configured to be coupled to the first linkage when the door opens the inlet.

12. The laundry-treating apparatus of claim 1, further comprising a second lock that selectively engages the second linkage when the door opens or closes the inlet.

13. The laundry-treating apparatus of claim 12, wherein the second lock is configured to be separated from the second linkage when the door closes the inlet, and wherein the second lock is configured to be coupled to the second linkage when the door opens the inlet.

* * * * *